US011193503B2

(12) United States Patent
Malard et al.

(10) Patent No.: US 11,193,503 B2
(45) Date of Patent: Dec. 7, 2021

(54) PUMP ASSEMBLY WITH A VERTICAL PUMP ARRANGED IN A CANISTER

(71) Applicant: Sulzer Management AG, Winterthur (CH)

(72) Inventors: Nicolas Malard, Vancouver, WA (US); Nicolas Lagas, Portland, OR (US)

(73) Assignee: SULZER MANAGEMENT AG, Winterthur (CH)

( * ) Notice: Subject to any disclaimer, the term of this patent is extended or adjusted under 35 U.S.C. 154(b) by 0 days.

(21) Appl. No.: 16/912,972

(22) Filed: Jun. 26, 2020

(65) Prior Publication Data

US 2021/0003148 A1 Jan. 7, 2021

Related U.S. Application Data

(60) Provisional application No. 62/869,080, filed on Jul. 1, 2019.

(51) Int. Cl.
*F04D 29/66* (2006.01)
*F04D 3/00* (2006.01)

(52) U.S. Cl.
CPC ..... *F04D 29/669* (2013.01); *F04D 3/00* (2013.01)

(58) Field of Classification Search
CPC ..... F04D 29/669; F04D 29/66; F04D 29/606; F04D 13/10; F04D 3/00; E21B 17/1021
See application file for complete search history.

(56) References Cited

U.S. PATENT DOCUMENTS 2,728,399 A 12/1955 Kluck
3,556,042 A 1/1971 Laughlin
4,768,925 A * 9/1988 Geupel ..... F02M 37/10 415/213.1
7,140,431 B2 * 11/2006 Betts ..... E21B 43/103 166/241.6
9,051,791 B2 * 6/2015 Fayo ..... E21B 17/1028
9,182,001 B2 * 11/2015 Pesek ..... F16L 55/041
10,788,023 B2 * 9/2020 Eggertson ..... F04D 29/668
2011/0278777 A1 * 11/2011 Allaire ..... F04D 29/668 267/140.11
2013/0068311 A1 * 3/2013 Xiao ..... E21B 43/12 137/1
2013/0248206 A1 9/2013 Jordan et al.
2016/0238036 A1 * 8/2016 Gabhart ..... F04D 29/528

FOREIGN PATENT DOCUMENTS

DE 8704677 U1 6/1987

* cited by examiner

*Primary Examiner* — Richard A Edgar
*Assistant Examiner* — Jackson N Gillenwaters
(74) *Attorney, Agent, or Firm* — Global IP Counselors, LLP

(57) ABSTRACT

A pump assembly includes a vertical pump arranged in a canister. The vertical pump includes a pump column disposed between a pump head and a pump bowl in an axial direction. The pump is arranged in the pump column and is configured to pump a fluid a column inlet at the pump bowl to a column outlet at the pump head. The pump column is supported so as to be stabilized by at least two damping arms disposed on an outer surface of the pump column, and each damping arm has an support end to support a respective damping arm on an inner surface of the canister in a radial direction perpendicular to the axial direction. Each support end is movable independently from each other support end with respect to the axial direction.

13 Claims, 5 Drawing Sheets

PUMP ASSEMBLY WITH A VERTICAL PUMP ARRANGED IN A CANISTER

CROSS-REFERENCE TO RELATED APPLICATION

This application claims priority to U.S. Provisional Patent Application No. 62/869,080, filed Jul. 1, 2019, the contents of which are hereby incorporated herein by reference in their entirety.

BACKGROUND

Field of the Invention

The invention relates to a pump assembly with damping arms for suppressing the vibration of a pump column of a vertical pump.

Background Information

Conventional vertical pumps have been used successfully in a plurality of applications for a very long time. Conventional vertical pumps for specific applications are quite often designed and manufactured in accordance with the specifications of the users or are matched in detail to specific requirements. A vertical pump is installed to operate in the vertical direction and comprises a column inlet for a fluid at the lower end of the pump, a column outlet for the fluid at the upper end of the pump and a pump column arranged between the column inlet and the column outlet. The fluid to be pumped enters the pump at the suction side through the column inlet and flows through the pump column to the column outlet at the discharge side. Vertical pumps can be designed both as single stage and multistage pumps. They are typically immersed into the fluid to be pumped, so that at least the intake or suction bell at the column inlet with the adjoining pump rotor is immersed into the fluid so that the pump is directly ready for operation.

One typical field for the use of a vertical pump is in pumping systems where the available net positive suction head ($NPSH_A$, the subscript 'A' standing for 'available') is limited for example due to system constraints or liquids operating near their vapor pressure. For such an application, the vertical pump either comprises or is arranged in a concentric canister surrounding the pump column. The fluid to be pumped enters the canister essentially at the level of the column outlet, so that the difference in height between the column inlet and the column outlet increases the suction pressure at the column inlet therewith increasing the available NPSH at the impeller. This is one of the reasons why a vertical pump has to be designed with large flexibility regarding the length of the pump column, so that the pump can be matched to the specific conditions and NPSH requirements at the operation site.

Typical applications of this type comprise liquid petroleum gas (LPG) boosting, tank farm and pipeline boosting, conveying of liquefied natural gas (LNG) or ethene, use in cryogenic gas plants, use in heat exchange circuits using evaporation and condensation of a fluid, or other applications in the oil and gas industry, for example in the refining process.

In addition to such processes where cryogenic fluids like LNG have to be pumped, vertical pumps are also used for conveying very hot fluids, for example in the energy generation with solar energy systems, especially with concentrated solar power (CSP) systems, where the sunlight heats a heat transfer fluid (HTF). Nowadays, one of the preferred heat transfer or heat storage fluids is molten salt. The molten salt that has to be pumped by the vertical pump has for example a temperature of up to 350° C. on the cold side of the process and up to 600° C. on the hot side of the process.

One typical and well-known setup of a vertical pump comprises a pumping unit with an inlet at a pump bowl and at least one impeller located near the inlet for conveying the fluid. The pumping unit is connected by a vertically upwards extending pump column to a discharge unit having an outlet for the fluid below a pump head. On top of the discharge unit a drive unit is disposed at the pump head for driving the impeller. The drive unit is operatively connected to the impellers by a line shaft extending through the length of the pump column. Usually the vertical pump is supported by a foundation arranged beneath and in the proximity of the column outlet, such that the pumping unit and the main part of the pump column freely hang without further support.

SUMMARY

One of the problems with vertical pumps is the vibration of the pump column that can be caused, for example, by unbalance or misalignment of rotating parts and exacerbated by structural natural frequencies of the pump installation. In former times, vertical pumps were mostly designed by rule of thumb. Due to a lack of reliable analytical methods many of these pumps were designed with structural natural frequencies at or near the running speed of the pump or multiples thereof. For example, when the pump is running at 1800 rpm this corresponds to a frequency of 30 Hertz. If 30 Hertz is near a structural natural frequency of the system the pump is running at a speed corresponding to a structural natural frequency of the pump system, a phenomenon called resonance, thus exacerbating vibrations. When such a matching occurs, a considerable load results, especially on the bearings, which causes, for example, a premature failure of the bearings or the line shaft. In addition, enhanced wear or other negative degradation effects can occur.

Some vertical pumps can be subject to a computational modal analysis or numerical simulations before manufacturing to avoid mechanical resonance effects causing strong vibrations especially of the pump column. However, very small modifications in the pump characteristics, which are for example caused by parameters that are not known with a sufficient accuracy, can have large, unforeseen effects on the natural frequencies (eigenfrequencies) of the pump installation resulting in resonance vibrations at frequencies where none were predicted during the analysis. As an example, one of the parameters which is quite often not or not sufficiently known during the analysis is the stiffness of the foundation supporting the pump at the operation site. it has been found that this parameter can be very difficult to quantify. Another example is the design of the stool or the stand for the motor driving the pump. Sometimes even the natural frequencies of the motor itself are not sufficiently known.

Thus, there is quite often a need to solve vibration problems on the operation site of the vertical pump. One simple solution is to fix the column of the vertical pump to the canister at appropriate locations between the suction side and the discharge side in order to stiffen the pump column and to shift the natural frequencies and avoid resonance. However, for nearly all applications this solution cannot be used because it is a requirement that the vertical pump with the pump column must be easily removable from the canister, for example to perform service, maintenance or repair work. Therefore, the pump column cannot be fixed to the canister except at the foundation supporting the pump.

Another solution that has been successfully used for solving vibration problems in a vertical pump is providing passive dynamic absorbers (PDA) that are mounted to the drive unit, for example the motor, that drives the pump. Still another known solution is the tuning of the stiffness of the foundation supporting the pump. By this measure the natural frequencies of the pump installation can be shifted away from the running speed of the pump. This tuning can be achieved by adding a resilient layer at the foundation.

However, both solutions, the PDAs and the resilient layers, have only a very narrow range of effectiveness for suppressing or damping the vibration of the pump column. Already small changes to the pump configuration or the pump operation can have the result that the PDAs or the resilient layers completely lose their ability to damp or to suppress the vibration. In addition, such solutions are only suited for pumps running at a fixed speed. Furthermore, PDAs are a highly engineered solution requiring a high level of expertise for the design, the installation and the maintenance, which renders this solution quite expensive. The resilient layer is a solution that usually can not be easily designed before installation but has to be tested iteratively in a trial and error procedure.

A further solution for solving the vibration problems are bow centralizers also called bow-spring centralizers. Bow centralizers usually comprise a plurality of metal strips, shaped like a bow and are attached to the outside of the pump column. Bow centralizers are used to keep the pump column in the center of the canister during operation of the vertical pump.

For explanation of the bow centralizers, reference is made in the following to FIG. 1, which provides a somewhat more detailed description of the bow centralizers described above. In order to distinguish the state of the art from the present invention, the reference signs referring to features of known examples of the bow centralizer are marked with an apostrophe, while features of examples according to the invention are marked with reference signs which do not bear an apostrophe.

FIG. 1 shows a side view of a conventional bow-centralizer 10'. The bow-centralizer 10' can be installed on a pump column of a vertical pump, to support the pump column in a stabilizing manner. The bow-centralizer 10' can therefore be mounted between the pump column of the vertical pump and a canister surrounding the vertical pump.

The bow-centralizer 10' comprises a first retainer 201', a second retainer 202', and a plurality of damping bows 15'. In a mounted-state of the bow-centralizer 10' the first retainer 201' and the second retainer 202' are arranged around the pump column and the damping bows 15' are connected to the first retainer '201' and to the second retainer 202'. Each damping bow 15' comprises a support end 150', which is a peak of the damping bow 15'. The support end 150' is arranged at an axial position between the first retainer 201' and the second retainer 202' in an axial direction A'.

The bow-centralizer 10' is arranged on the vertical pump and then the vertical pump is installed by dropping the vertical pump with the bow-centralizer 10' in the canister. In an operating state of the vertical pump the bow-centralizer 10' suppresses vibrations of the pump column by contacting the canister with the support ends 150', thereby supporting the pump column against the canister.

Even if vibrations can be suppressed by installation of the bow centralizer, the production of bow centralizers requires machining steps with tight tolerances. Furthermore, the bow shape of the damping bows makes it hard to predict how they will deform when the vertical pump with the bow centralizer is dropped into the canister. The vertical pump can be bound to one side or another. Due to the bow shape much interference between the canister and the pump column should be avoided, because the vertical pump would be hard to install and the damping bows would deform too much and lose their stiffness.

However, another issue of the bow centralizers is, that if one of the support ends 150' of a single damping bow 15' is pressurized by the canister, due to the vibrations of the pump column in the operating state, the damping bow 15' deforms and the first retainer '201' and the second retainer 202' drift apart in the axial direction A'. This drifting apart results in a simultaneous deformation of all damping bows 15', thereby reducing the dampening effect of the bow centralizer 10'.

Therefore, it is an object of the invention to propose a pump assembly with a device for suppressing a vibration of a pump column of a vertical pump in such an effective manner that the described resonance effects can be avoided. The device should be easily installable and easily adaptable to the specific application. In addition, it is an object of the invention to propose a pump assembly that allows for a suppressing of a vibration of its pump column in a simple and cost-efficient manner and which avoids the disadvantages known from the state of the art.

The subject matter of the invention satisfying these objects is characterized by the features described herein.

Thus, according to an embodiment of the invention, a pump assembly comprising a vertical pump arranged in a canister is proposed. The vertical pump of the pump assembly comprises a pump column, which is disposed between a pump head and a pump bowl in an axial direction, wherein a fluid can be pumped from a column inlet at the pump bowl to a column outlet at the pump head by a pump device arranged in the pump column. The pump column is supported in a stabilizing manner by at least two damping arms disposed on an outer surface of the pump column. Each damping arm has an support end, for supporting the respective damping arm on an inner surface of the canister in a radial direction perpendicular to the axial direction. The pump assembly is characterized in that each support end and is movable independently from the other support end or the other support ends with respect to the axial direction.

The at least two damping arms create a link between the pump column and the canister that rigidifies/stabilizes the column assembly. The damping arms are preferably connected to the pump column and can contact the inner surface of the canister with the support ends in dependence of the operating state of the pump assembly. As the damping arms are independent in movement, they will follow a shape of the pump column and allow a contact all around in every operating state. Since each support end is independently and freely movable regarding the other support end or support ends in particular with respect to the axial direction, each support end can be individually pressurized in the operating state, thereby changing an axial position due to a movement in the axial direction, without effecting the axial position of the other support end or support ends. Thus each support end can be moved without causing a movement of the other support end or support ends.

The pump assembly comprises at least two damping arms. However, the pump assembly can comprise any suitable number of damping arms (exceeding two) in order to support the pump column in a stabilizing manner. The pump assembly can comprise for example three damping arms or four damping arms or five damping arms or six damping arms or of course any suitable number of damping arms wherein each damping arm includes its own support end. Consequently, the pump assembly comprises a plurality of damping arms. Each damping arm having a support end which extends towards the inner surface of the canister, in order to further support the pump column in the radial direction and which is independently and freely movable from the other support ends with respect to the axial direction. Within the scope of the application a plurality of damping arms is at least two damping arms up to any suitable number of damping arms, such as eight or ten or even more damping arms.

The damping arms are preferably mounted to the pump column and are arranged between the pump column of the vertical pump and the canister surrounding the pump column at a location between the column inlet and the column outlet. Preferably, the damping arms are firmly fixed to the pump column. When the vertical pump is in operating state, the damping arms introduces a stiffness and stability between the canister and the pump column, possibly accompanied by a bracing force. Each damping arm can engage the inner surface of the canister independently, thus forming an individual stabilizing connection between the canister and the pump column. These plurality of independent connections between the canister and the pump column result in the bracing force for suppressing a vibration. The pump column can be clamped and/or supported by the damping arms, when the damping arms are supported with their support end on the inner surface of the canister.

In a preferred embodiment, each damping arm is a lever and comprises a connecting end connected to the pump column. In this embodiment the connecting end of each damping arm is a fulcrum of the lever and the support end of each damping arm is a load point of the lever. When the load point of one damping arm is exposed to a force in the operating state, the support end changes its axial position, due to the damping arm moving about the fulcrum. Since, no other damping arm is effected by such a movement, each damping arm is independently and freely movable from the other damping arms with respect to the axial direction. In contrast to the state of the art there is no connection between the damping arms, which would effect or couple the movement in the axial direction of the support ends of the damping arms.

Additionally, a respective angle between the pump column and each of the damping arms is smaller than 90° and larger than 0°. In particular, the respective angle is about 10° to 80°, preferably 30° to 80°, especially preferred 30° to 60°. The angle can also vary due to the operating state of the vertical pump, since the damping arms can be bendable about the fulcrum, with respect to the radial direction so that the vibrations of the vertical pump are can be buffered and suppressed. As an essential aspect, due to the independent movable damping arms the respective angle between the pump column and the damping arms can be different for different damping arms.

In a preferred embodiment the pump assembly comprises a vibration damper which is arranged at the column pump. The vibration damper each damping arm and a holding device. Each damping arm is mounted to the holding device.

In a preferred embodiment, all damping arms are firmly fixed to the holding device, which can be configured to be mountable around the pump column of the vertical pump. The holding device can have a shape corresponding to the pump column, in particular can be designed as a ring-shaped band, for example a metal band or a metal band divided into two semicircular pieces (a first half shell and a second half shell), with a fastener so that the holding device with the damping arms mounted to it can be fixed to the pump column in a very simple manner.

In a further embodiment the holding device comprises a first retainer and a second retainer, the first retainer and the second retainer being mounted around the pump column, wherein each damping arm is connected to the first retainer and to the second retainer. As another beneficial measure, each support end can comprise a flattened edge which faces towards the inner surface of the canister.

It is also possibly to arrange two or more vibration dampers at the same pump column, for example to suppress vibrations that are caused by different natural frequencies of the vertical pump. Thereby it is possible to eliminate or at least to increase all modes that are within, at or near the operational speed(s) of the vertical pump to above the maximum operating speed of the pump. Each vibration damper is arranged at a different axial position in the axial direction. The appropriate axial position between the column inlet and the column outlet at which each vibration damper is placed is preferably determined in dependence on the specific natural frequency or the target mode that shall be addressed. It is preferred to arrange the vibration damper at or near the antinode of the target mode. Of course, a plurality of vibration dampers can be added at different axial positions along the length of the pump column in order to add more stability and focus on multiple target modes. However for practical reasons it is preferred that there are at most two vibration dampers at two different positions with respect to the axial direction.

The damping arms according to the invention enable a very efficient suppressing of the vibration of the pump column. In addition, the damping arms are very easy to install and very flexible with respect to their application, because they can be arranged at any appropriate location between the pump column and the canister. According to the invention each damping arm has a radial dimension in the radial direction, the pump column is clamped by the damping arms extending between the pump column and the canister and firmly engaging both the pump column and the canister. Even if the plurality of damping arms is designed to permanently contact the canister, due to their independent movability, it is also possible that one or more of the damping arms loses or lose completely contact with the canister depending on the operating state.

For most of the embodiments it is preferred that the vibration damper has three or four damping arms. For other application there might be up to eight or even ten arms. Furthermore, it is preferred that all damping arms are arranged at the same axial position around an outer circumference of the pump column. The damping arms can be distributed equidistantly around the outer circumference of the pump column. Preferred are such embodiments, which have at least three or four to ten damping arms provided on the outer surface of the pump column When fitting the vertical pump into the canister, the plurality of damping arms is disposed on the pump column on at least one selected axial position. Then the damping arms or the vibration damper, respectively, are/is mounted at the selected axial position (or respectively the vibration damper) fixed to the pump column and the vertical pump is inserted into the canister. In order to facilitate this insertion, the damping arms can be orientated along the axial direction with their support end extending towards the pump head.

The damping arms according to the invention are particularly suited for retrofitting already existing vertical pumps.

If there is a resonance issue at a specific vertical pump, e.g. because a structural natural frequency of the pump installation is equal or very close to the running speed of the pump, the arrangement of damping arms according to the invention provides an efficient, very simple and cost-efficient solution for suppressing vibrations caused by said natural frequency. Thus, there is no need for a complete redesign of the pump. The resonance issue can be solved by providing at least two damping arms, preferably three or four damping arms to the pump column of the pump.

Further advantageous measures and embodiments of the invention will become apparent from the dependent claims.

BRIEF DESCRIPTION OF THE DRAWINGS

The invention will be explained in more detail hereinafter with reference to the drawings.

DETAILED DESCRIPTION

Figure 1:
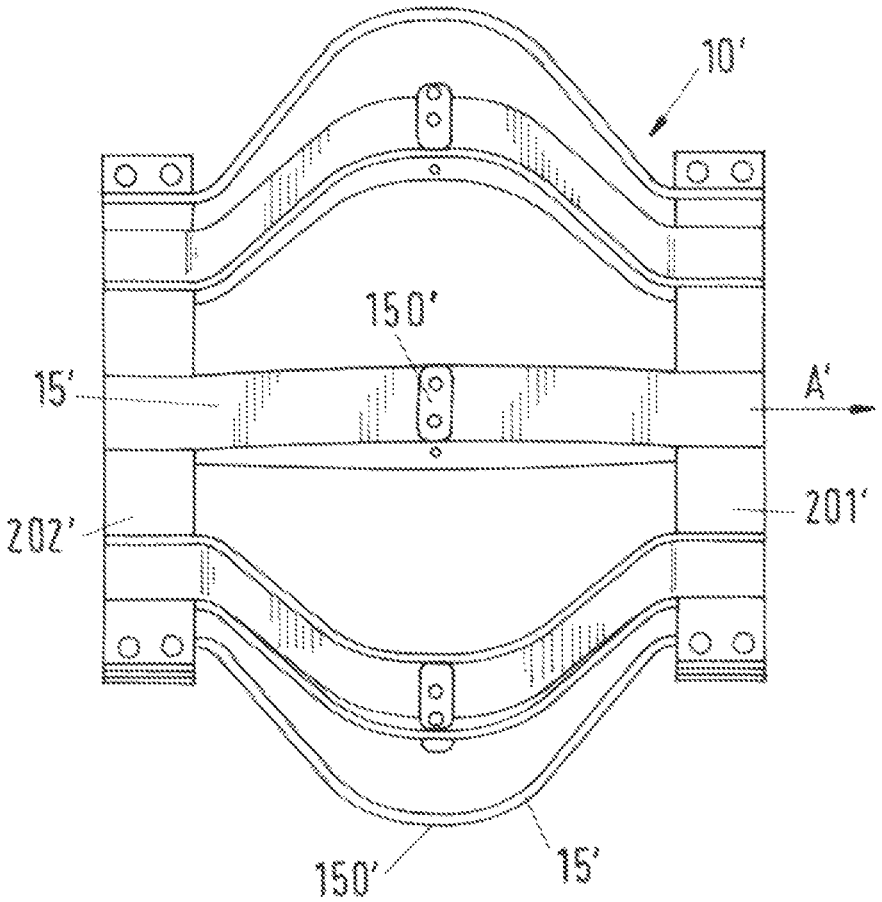
(Prior Art) Fig.1
FIG. 1 is a bow centralizer as already known in the state of the art.

FIG. 1 shows a schematic illustration of the state of the art, which has already been described above. As already mentioned above, the reference signs of FIG. 1 contain an apostrophe (or prime), since they refer to the state of the art.

Figure 2:
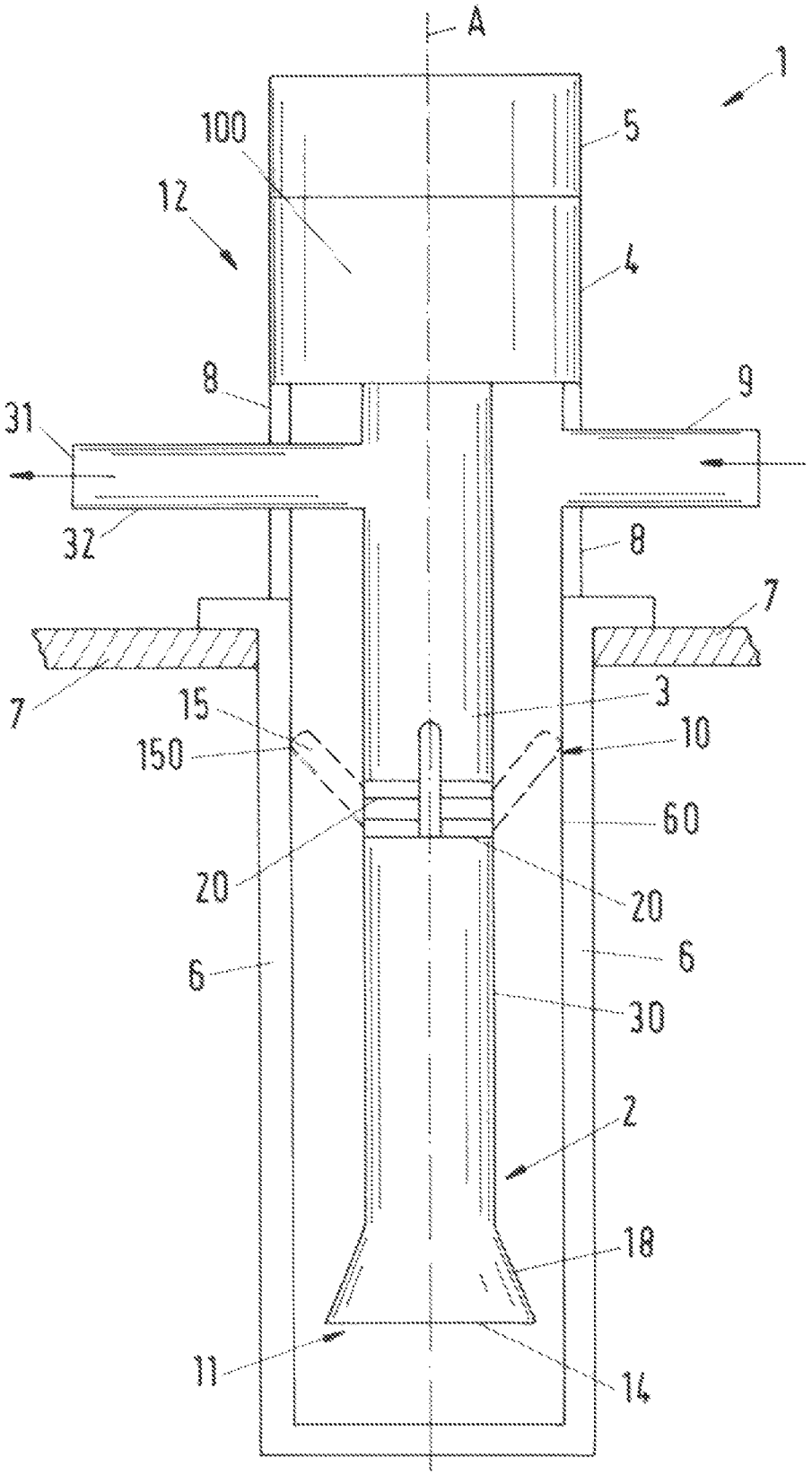
FIG. 2 is a schematic representation of an embodiment of a vertical pump according to the invention.

FIG. 2 shows a schematic representation of an embodiment of a pump assembly according to the invention which is designated in its entirety with reference numeral 1. The pump assembly 1 comprises a vertical pump 100 arranged in a canister 6. The basic structure of the vertical pump 100 as such is known from the prior art. However, the general description given with reference to FIG. 2 is also valid for an embodiment of a vertical pump 100 according to the invention.

FIG. 2 shows the vertical pump 100 in its usual operating position, i.e. in vertical orientation. Hereinafter relative terms regarding the location like "above" or "below" or "upper" or "lower" refer to this operating position shown in FIG. 2.

The vertical pump 100 has a pump bowl 11 (at a lower end), a pump head 12 (at an upper end) and a pump column 3 arranged between the pump bowl 11 and the pump head 12. The vertical pump 100 comprises a pumping unit 2 located at the pump bowl 11 of the pump 100. The pumping unit 2 includes a suction bell 18 having an column inlet 14 for a fluid to be pumped and with at least one impeller 19 (see FIG. 3, not shown in FIG. 2), but quite often a plurality of impellers 19 (pump device) for conveying the fluid from the column inlet 14 to an column outlet 31 below the pump head 12 of the pump. The impellers 19 are mounted in series on a pump shaft (pump device, not shown) in a torque-proof manner. The pump shaft for rotating the impeller(s) 19 is sometimes also referred to as line shaft.

From the pump head 12 of the pumping unit 2 the tubular pump column 3 vertically extends upwards to connect the pumping unit 2 to a bearing unit 4 for supporting the pump shaft that vertically extends within the pump column 3. The pump column 3 is in fluid communication with a discharge pipe 32 arranged at the pump head 12 and connects the pump column 3 with the column outlet 31 for discharging the pumped fluid. The pump column 3 extends in an axial direction A that is defined by the rotational axis of the pump 100 about which the impeller(s) 19 is/are rotating during operation. The axial direction A coincides with the vertical direction, i.e. with the direction of gravity, when the pump 100 is in its usual operating position. A direction perpendicular to the axial direction A is referred to as radial direction.

On top of the bearing unit 4, a drive unit 5 is arranged for driving the impeller(s) 19 of the pump 100. The drive unit 5 can be, for example, an electric motor or any other driver. The drive unit 5 is operatively connected to the impeller 19 by the pump shaft or the line shaft extending in the center of the pump column 3 and coaxially therewith. The pump shaft is supported by the bearing unit 4 and a plurality of shaft bearings arranged within the pump column 3 at different heights for guiding the pump shaft along its entire axial length.

The vertical pump 100 is arranged in a canister 6 surrounding the pump column 3. The canister 6 is of essentially cylindrical shape and extends in the axial direction A to receive the pump column 3 and the pumping unit 2 of the vertical pump 100. At its upper end, the canister 6 is supported by a foundation 7 and can be fixed to the foundation 7 by screws or bolts (not shown) or any other appropriate means or device.

The vertical pump 100 further comprises a support structure 8 arranged below the bearing unit 4, which supports the entire vertical pump 100. As shown in FIG. 2 the support structure 8 can rest on the canister 6 or can be mounted to the canister 6. Alternatively, or additionally, the support structure 8 can also be directly connected to or supported by the foundation 7. The pump column 3 and the pump unit 2 usually freely hang, i.e. without additional support, into the canister 6.

Approximately at the same height with respect to the axial direction A where the discharge pipe 32 is arranged, an inlet pipe 9 is disposed through which the fluid to be pumped can enter the canister 6 as indicated by the arrow without reference numeral on the right side of FIG. 2. During operation of the pump 100 the canister 6 is completely filled with the fluid to be pumped. The fluid enters the canister 6 through the inlet pipe 9, is sucked through the column inlet 14 of the pump 100 by the action of the rotating impeller(s) 19 and discharged through the discharge pipe 32 as indicated by the arrow without reference numeral on the left side of FIG. 2.

The difference in height (with respect to the axial direction A) between the column inlet 14 of the pump 100 which is arranged at the pump bowl 11 and the inlet pipe 9 for the fluid which is arranged below the pump head 12 increases the suction pressure at the column inlet 14 of the pump 100, thus also increasing the available net positive suction head (NPSH).

According to an embodiment of the invention a vibration damper 10 is disposed between the pump column 3 and the canister 6 for suppressing the vibration of the pump column 3. The vibration damper 10 comprises at least two damping arms 15. In the embodiment shown in FIG. 2, four damping arms 15 are provided. The vibration damper 10 further comprises, a holding device 20. The four damping arms 15 are mounted to the holding device 20, which holding device 20 is arranged around the pump column 3.

The pump column 3 is supported in a stabilizing manner by the damping arms 15 disposed on an outer surface 30 of the pump column 3. Each damping arm 15 comprises a support end 150 which extends towards an inner surface 60 of the canister 6, in order to support the pump column 3 in a radial direction, which radial direction is perpendicular to the axial direction A. The pump assembly 1 is characterized in that each support end 150 is movable independently from the other support ends 150 with respect to the axial direction A.

The damping arms 15 therefore create a link between the pump column 3 and the canister 6 that rigidifies and stabilizes the pump assembly 1. The damping arms 15 are connected to the pump column 3 and contact the inner surface 60 of the canister 6 with the support ends 150, in dependence of the operating state of the pump assembly 1. As the damping arms 15 are independent in movement, they will follow a shape of the pump column 3 and allow a contact all around in every operating state.

The damping arms 15 are orientated along the axial direction A with their support ends 150 extending towards the pump head 12.

Figure 3:
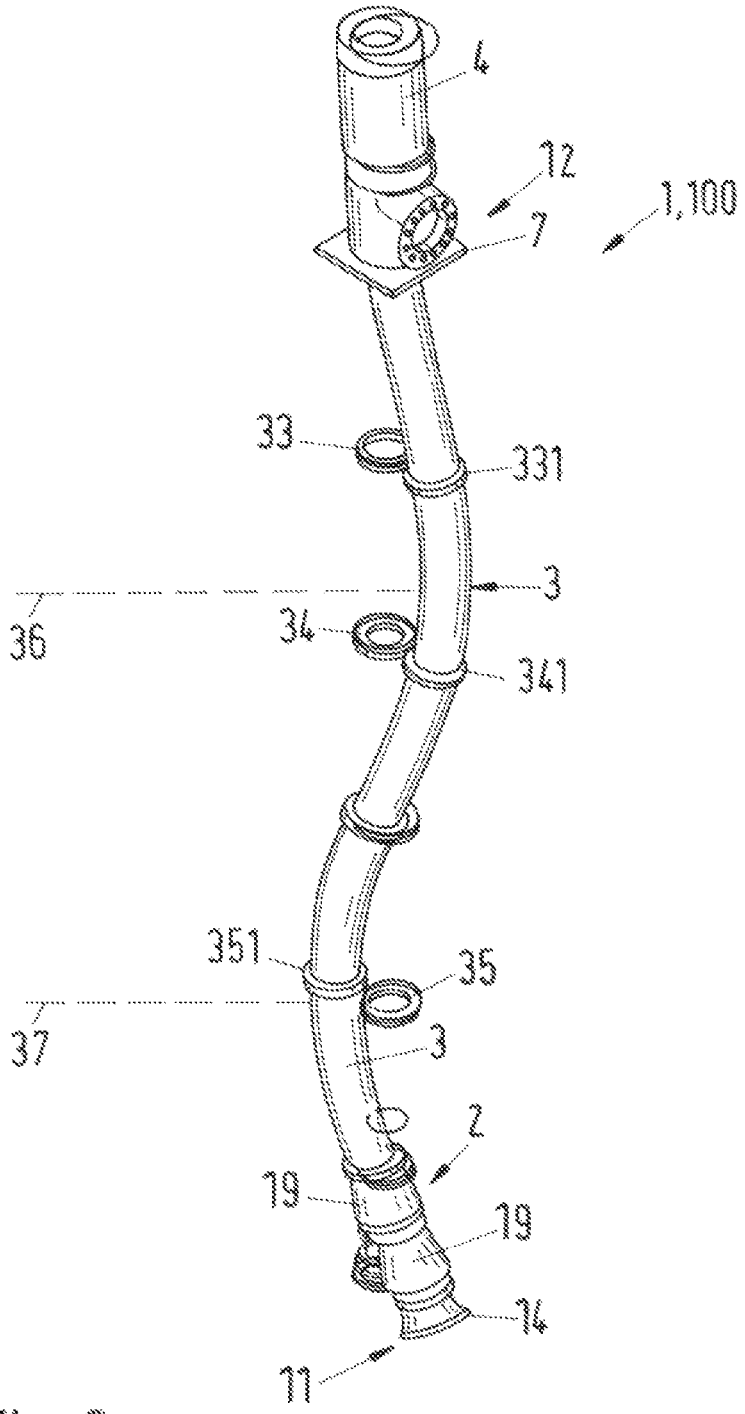
FIG. 3 is a mechanical vibration mode shape of a pump column, which can also be approximated as operational vibration due to an excitation of a natural frequency.

By way of example, FIG. 3 shows a vibration mode of the pump column 3 that is due to an excitation of a specific natural frequency. If the rotational speed of the drive unit 5 corresponds to a frequency which is equal or close to this structural natural frequency of the system, the corresponding mode is excited, resulting in strong vibrations. Since the pump column 3 is essentially only supported by the foundation 7 but otherwise freely hanging in the canister 6 the pump column 3 and the pump unit 2 attached to it can experience such oscillations as shown in FIG. 3. These resonant effects can have detrimental impacts on the pump 100. In particular, a premature failure of the bearings like the shaft bearings can be caused by resonance.

In FIG. 3 the locations denoted with reference numerals 33, 34, 35 represent the location of the pump column 3 when the pump 100 is not in operation and there is no vibration, while the locations denoted with reference numerals 331, 341, 351 represent the pump column 3 in a vibration mode when the corresponding structural natural frequency (eigenfrequency) of the vibratory system is excited, for example by the rotational frequency of the drive unit 5.

In order to resolve these resonant vibrations, the present invention proposes damping arms 15 for suppressing such vibrations or in other words for shifting the structural natural frequency of the vibratory system to such high frequencies which are far away e. g. from the rotational frequency of the drive unit 5.

Preferably a plurality of damping arms 15 is located at or near such a height between the column inlet 14 and the column outlet 31 where the antinode of the vibration mode to be suppressed is located. It goes without saying that more than two pluralities of damping arms 15 can be arranged between the pump column 3 and the canister 6 at different axial positions (i.e. different heights).

Furthermore, the vibration damper 10 comprises the damping arms 15 and the holding device 20. The damping arms 15 are mounted to the holding device 20, wherein more than one vibration damper 10 can be arranged between the pump column 3 and the canister 6 with said vibration dampers 10 being located at different axial positions (i.e. different heights with respect to the axial direction A). For suppressing the vibration mode illustrated in FIG. 3, for example a first vibration damper 10 can be located at a height indicated by the level 36 and a second vibration damper 10 can be located at a height indicated by level 37 in FIG. 3. Of course, it is also possible to locate individual vibration dampers 10 at such heights that they suppress vibration modes belonging to different structural natural frequencies of the vibratory system. For example, level 37 can be a good location for the vibration damper 10 as it is near the antinodes for the first three lateral column modes.

Figure 4:
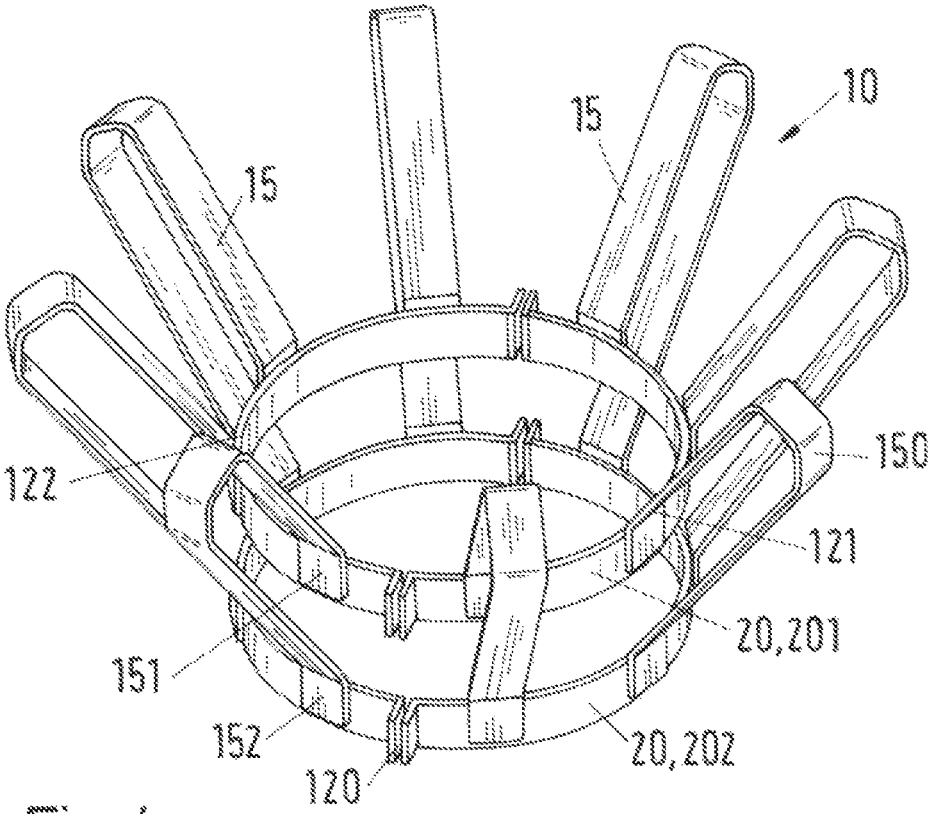
FIG. 4 is a perspective view of a first embodiment of a vibration damper according to the invention.

FIG. 4 shows a perspective view of an embodiment of the vibration damper 10 according to the invention. The basic design of the vibration damper 10 is such that at least two damping arms 15 are arranged at the pump column 3 for adding stiffness and stability between the canister 6 and the pump column 3. Thus, the damping arms 15 clamp and/or support the pump column 3 against the canister (not shown in FIG. 4) therewith suppressing or at least dampening the vibration of the pump column 3.

The damping arms 15 are arranged at the holding device 20 and are therefore a component of the vibration damper 10. The vibration damper 10 comprises the plurality of, here eight, damping arms 15, each of which is designed to move independently from the other damping arms 15.

As shown in FIG. 4 the eight damping arms 15 are fixed to the holding device 20, which is configured to be mounted around the pump column 3. The holding device 20 is designed as an essentially ring-shaped band, wherein the inner diameter of the ring-shaped band is such that the holding device 20 closely fits around the pump column 3. The holding device 20 comprises a first half shell 121, and a second half shell 122. The first half shell 121 and the second half shell 122 are connected by a fastener 120. The fastener 120, for example a clasp or a flange, or a screw connection, is designed such that the holding device 20 can be easily mounted to or removed from the pump column 3. Due to the fastener 120, the holding device 20 can be opened to receive the first half shell 121 and the second half shell 122 and the first half shell 121 and the second half shell 122 can be removed from the pump column 3. When the fastener 120 on the other hand is closed, the holding device 20 is fixed to the pump column 3. For removing the holding device 20 from the pump column 3 only the fastener 120 must be opened and the holding device 20 can be easily removed.

The holding device 20 of FIG. 4 further comprises a first retainer 201 and a second retainer 202, which are mounted around the pump column 3. Each of the damping arms 15 is connected with a first connecting end 151 to the first retainer 201 and with a second connecting end 152 to the second retainer 202.

Preferably, the damping arms 15 are equidistantly arranged on the holding device 15, such that the damping arms 15 are equidistantly located about the circumference of the pump column 3 when the holding device 20 is mounted to the pump column 3, such that the damping arms 15, restrain the pump column 3 equally in all radial directions. Each damping arm 15 is designed such that its support end 150 is located above the first retainer 201 and the second retainer 202 with respect to the axial direction A.

For most applications it is sufficient to provide at most two vibration dampers 10. Preferably, each vibration damper 10 has three or four to eight damping arms 15. The vibration dampers 10 can be located at different heights of the pump column i.e. at different positions with respect to the axial direction A (not shown in FIG. 4). By this measure all structural natural frequencies can be increased to such an extent that they are considerably higher than the excitation frequencies occurring in the operating speed range of the vertical pump 100.

Figure 5:
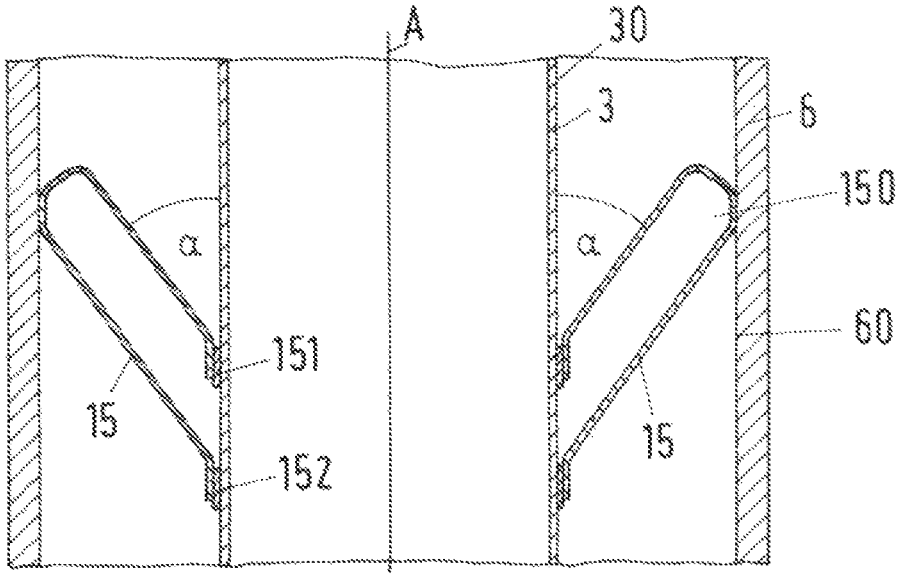
FIG. 5 is a cross-sectional view of a variant of the first embodiment of the vibration damper shown in FIG. 4.
Figure 6:
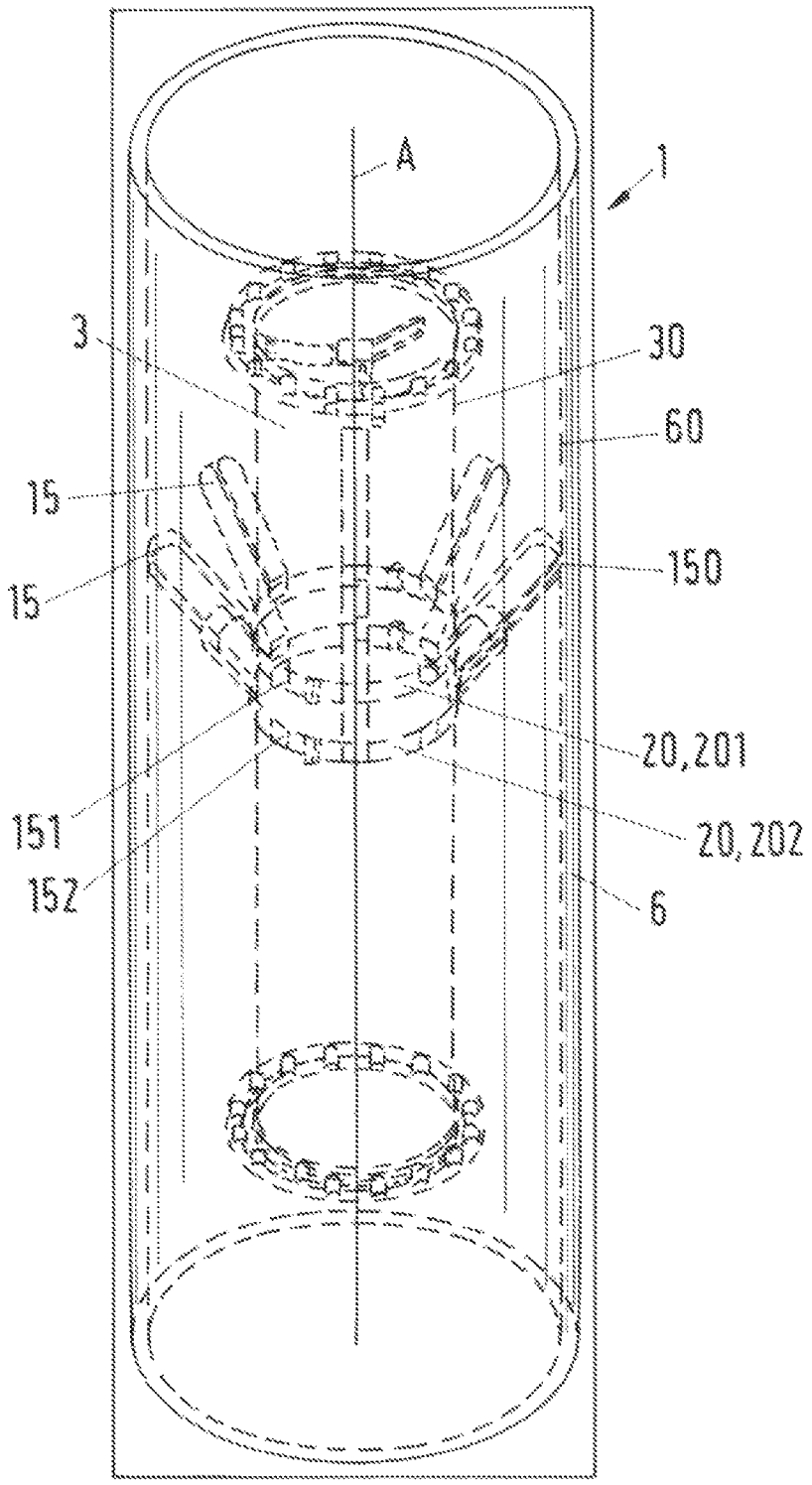
FIG. 6 is a representation of the vibration damper of FIG. 5 arranged on a pump column.

FIG. 5 shows a cross-sectional view of a variant of the first embodiment of the vibration damper 10 shown in FIG. 4. In addition, FIG. 6 shows a front view of the vibration damper 10 of FIG. 5 arranged on a pump column 3. The damping arms 15 shown in this variant comprise a flattened edge at the support end 150, which faces towards the inner surface 60 of the canister 6.

Each damping arm 15 can engage the inner surface 60 of the canister 6 independently, thus forming a stabilizing connection between the canister 6 and the pump column 3. The pump column 3 can be clamped and/or supported by the damping arms 15, when the damping arms 15 are supported with their support end 150 on the inner surface 60 of the canister 6. Each damping arm 15 is a lever and comprises the connecting end 151, 152 connected to the outer surface 30 of the pump column 3 (i.e. to the first retainer 201 and the second retainer 202). The connecting end 151, 152 of each damping arm 15 is a fulcrum of the lever and the support end 150 of each damping arm 15 is a load point of the lever, at which load point the damping arm contacts the inner surface 60 of the canister 6. Additionally, an angle $\alpha$ between the pump column 3 and each damping arm 15 is larger than 0° and smaller than 90°. Preferably, the angle $\alpha$ is about 10° to 80°, more preferred 30° to 80°, especially preferred 30° to 60°. The angle $\alpha$ can also vary due to the operation of the vertical pump 100, since the damping arms 15 can be bendable, with respect to the radial direction so that the vibrations of the vertical pump 100 are suppressible. Therefore, if the support end 150 of a single damping arm 15 is pressurized in the operating state the damping arm will move about the fulcrum (in the radial direction) and the support end 150 will independently and freely move with respect to the axial direction A, without affecting an axial movement of another damping arm 15.

Referring now to all described embodiments and variants of the vibration damper 10 or the damping arms 15, respectively, it is also possible to directly fix the individual damping arms 15 at an appropriate location to the pump column 3, for example by welding. Thus, it is not necessary that the damping arms 15 are fixed to the pump column 3 via the holding device 20.

For most applications it is preferred that three or four damping arms 15 are arranged at the same height between the pump bowl 11 and the pump head 12 of the pump 100. For other applications up to eight damping arms 15 arranged at the same height (with respect to the axial direction A) can be preferred. In any case it is preferred that the damping arms 15 are equidistantly distributed along the circumference of the pump column 3 at said height.

In addition, for many applications it is sufficient to have at most two vibration dampers 10 at different heights with respect to the axial direction A in order to shift all structural natural frequencies of the vibratory system to higher frequencies than the frequencies at which the vertical pump 100 is operated.

In many applications it is not needed or even not desired that the pump column 3 of the vertical pump 100 is centered with respect to the canister 6 in the mounted state, i.e. the distance in radial direction between the pump column 3 and the canister 6 varies along the circumference of the pump column 3 and/or along the height of the pump column 3 in axial direction A. In such applications it is not desired that the damping arms 15 exert a centering force on the pump column 3 because such additional centering forces could result in additional loads acting on parts of the pump 100, for example on the bearings.

Preferably all damping arms 15 are configured in an identical manner, so that each vibration damper is very easy to manufacture. Slight deviations of the canister 6 and/or the pump column 3 from a circular cross-section are then compensated by the damping arms 15, because they are movable independently from each other. Thus, the deviations from a circular cross-section are automatically compensated, because each of the equally designed damping arms can include a different angle $\alpha$ with the pump column 3 than the other damping arms 15. Usually, the variation in the angle $\alpha$ as seen over all damping arms 15 is quite small and does not exceed one degree.

What is claimed:

1. A pump assembly comprising:

a vertical pump arranged in a canister, the vertical pump comprising a pump column disposed between a pump head and a pump bowl in an axial direction, a pump device being arranged in the pump column and configured to pump a fluid from a column inlet at the pump bowl to a column outlet at the pump head, and a vibration damper comprising a holder and at least two damping arms disposed so as to support and stabilize the pump column, each damping arm of the at least two damping arms has a support end to support a respective damping arm on an inner surface of the canister in a radial direction perpendicular to the axial direction, the holder mounted around the pump column and having a shape corresponding to a shape of the pump column, each damping arm of the at least two damping arms mounted to the holder, the holder comprising a first retainer and a second retainer, the first retainer and the second retainer being mounted around the pump column, each damping arm of the at least two damping arms connected to the first retainer and to the second retainer and orientated along the axial direction with the support end extending towards the pump head such that each support end is disposed above the first retainer and the second retainer with respect to the axial direction, and each support end being movable independently from each other support end with respect to the axial direction.

2. The pump assembly in accordance with claim 1, wherein the pump column and each of the damping arms defines a respective angle that is 10° to 80°.

3. The pump assembly in accordance with claim 2, wherein the holder comprises a first half shell and a second half shell, the first half shell and the second half shell being connectable by a fastener.

4. The pump assembly according to claim 2, wherein the holder is one of a plurality of vibration dampers, and each vibration damper of the plurality of vibration dampers being arranged at a different position in the axial direction.

5. The pump assembly in accordance with claim 1, wherein the holder comprises a first half shell and a second half shell, the first half shell and the second half shell being connectable by a fastener.

6. The pump assembly according to claim 5, wherein the holder is one of a plurality of vibration dampers, and each vibration damper of the plurality of vibration dampers being arranged at a different position in the axial direction.

7. The pump assembly according to claim 1, wherein the holder is one of a plurality of vibration dampers, and each vibration damper of the plurality of vibration dampers being arranged at a different position in the axial direction.

8. The pump assembly in accordance with claim 1, wherein each support end comprises a flattened edge, the flattened edge facing towards the inner surface of the canister.

9. The pump assembly in accordance with claim 1, wherein the at least two damping arms includes at least three damping arms disposed on the outer surface of the pump column.

10. The pump assembly in accordance with claim 1, wherein the damping arms are equidistantly distributed around an outer circumference of the pump column.

11. The pump assembly in accordance with claim 1, wherein the pump column and each of the damping arms defines a respective angle that is 30° to 80°.

12. The pump assembly in accordance with claim 1, wherein the pump column and each of the damping arms defines a respective angle that is 30° to 60°.

13. The pump assembly in accordance with claim 1, wherein the at least two damping arms includes four to eight damping arms disposed on the outer surface of the pump column.

* * * * *